US009528362B2

(12) United States Patent
Dragnea et al.

(10) Patent No.: US 9,528,362 B2
(45) Date of Patent: Dec. 27, 2016

(54) SYSTEMS AND METHODS FOR MANAGING HYDROCARBON MATERIAL PRODUCING WELLSITES USING CLAMP-ON FLOW METERS

(71) Applicant: Expro Meters, Inc., Wallingford, CT (US)

(72) Inventors: Gabriel Dragnea, Thornton, CO (US); Michael Sapack, Southbury, CT (US); Patrick Curry, Glastonbury, CT (US); Siddesh Sridhar, Meriden, CT (US)

(73) Assignee: Expro Meters, Inc., Wallingford, CT (US)

( * ) Notice: Subject to any disclaimer, the term of this patent is extended or adjusted under 35 U.S.C. 154(b) by 513 days.

(21) Appl. No.: 14/055,536

(22) Filed: Oct. 16, 2013

(65) Prior Publication Data

US 2014/0102697 A1 Apr. 17, 2014

Related U.S. Application Data

(60) Provisional application No. 61/714,524, filed on Oct. 16, 2012.

(51) Int. Cl.
*E21B 44/00* (2006.01)
*E21B 47/10* (2012.01)

(52) U.S. Cl.
CPC ..... *E21B 44/00* (2013.01); *E21B 47/10* (2013.01)

(58) Field of Classification Search
CPC ..... E21B 44/00; E21B 47/10
See application file for complete search history.

(56) References Cited

U.S. PATENT DOCUMENTS

| | | | |
|---|---|---|---|
| 6,889,562 | B2 | 5/2005 | Gysling et al. |
| 7,237,440 | B2 | 7/2007 | Gysling et al. |
| 7,295,933 | B2 | 11/2007 | Gysling et al. |
| 7,322,245 | B2 | 1/2008 | Gysling et al. |
| 7,389,187 | B2 | 6/2008 | Kersey et al. |
| 7,437,946 | B2 | 10/2008 | Gysling |
| 7,526,966 | B2 | 5/2009 | Gysling et al. |
| 7,603,916 | B2 | 10/2009 | Gysling |
| 8,061,186 | B2 | 11/2011 | Gysling |
| 8,428,892 | B2 | 4/2013 | Gysling |

(Continued)

OTHER PUBLICATIONS

Munro et al. "SPE 112140 First Mile Wireless and Beyond: Future Applications for Wireless in Oil and Gas", Feb. 27, 2008, https://www.onepetro.org/download/conference-paper/SPE-112140-MS?id=conference-paper/SPE-112140-MS.

(Continued)

*Primary Examiner* — William P Neuder
(74) *Attorney, Agent, or Firm* — O'Shea Getz P.C.

(57) ABSTRACT

A method and system for managing one or more hydrocarbon producing well sites is provided. The well site includes a hydrocarbon material flow passing through a pipe. The system includes a clamp-on flow meter and a control station. The clamp-on flow meter is operable to produce output indicative of at least one characteristic of the hydrocarbon material flowing through the pipe at the well site. The control station is separately located from the well site. The control station includes at least one processor adapted to receive the output from the clamp-on flow meter. The processor is adapted to determine one or more characteristics of the hydrocarbon material flow at each well site using a flow compositional model.

14 Claims, 7 Drawing Sheets

(56) References Cited

U.S. PATENT DOCUMENTS

| | | | | |
|---|---|---|---|---|
| 8,452,551 | B2 | 5/2013 | Gysling | |
| 2013/0299240 | A1 * | 11/2013 | Leuchtenberg | E21B 21/08 175/48 |

OTHER PUBLICATIONS

"Local Clamp-On Ultrasonic Flow and Energy Meter for Liquids", Dec. 12, 2010, http://www.bibbcontrols.com/Documents/TI-8-627ClampOnUltrasonicMeter.pdf.

International Search report for PCT/US2013/065267 dated Sep. 30, 2014.

* cited by examiner

SYSTEMS AND METHODS FOR MANAGING HYDROCARBON MATERIAL PRODUCING WELLSITES USING CLAMP-ON FLOW METERS

This application claims the benefit of U.S. Provisional Patent Application Ser. No. 61/714,524, filed Oct. 16, 2012.

BACKGROUND OF THE INVENTION

1. Technical Field

Aspects of the present invention generally relate to systems and methods for managing well sites, and more particularly relate to systems and methods for managing well sites using clamp-on flow meters.

2. Background Information

The production of hydrocarbon materials (e.g., oil, gas) typically begins with the removal of the materials from subterranean reservoirs at well sites. It is not uncommon for well sites to be located in harsh environments that are difficult to access. Flow meters are often used at well sites to determine information about the flow of materials being removed from the reservoir. Such information can be used to determine one or more performance characteristics (e.g., efficiency) of the well site, which in turn can be used to manage the well site. In prior art systems, however, it is often necessary to have significant personnel resources stationed at the well site to collect the information. In addition, the prior art systems are often time consuming and expensive. For example, to produce the desired information, existing well site management systems often require: a) a data analytical technician (e.g., a petroleum engineer, a computer processing engineer, an electrical engineer, etc.) and a well site operation technician; or b) a single technician that is trained to perform well site tasks as well as analytical tasks, to be stationed at the well site. These systems are cost intensive, time consuming, and cannot provide real time performance data.

SUMMARY OF THE INVENTION

According to an aspect of the present invention, a system for managing a plurality of hydrocarbon producing well sites is provided. Each of the well sites includes a hydrocarbon material flow passing through a pipe. The system includes a clamp-on flow meter attached to the pipe located at each of the plurality of well sites, and a control station. Each clamp-on flow meter is operable to output electronic signals indicative of at least one characteristic of the hydrocarbon material flowing through the pipe at that well site. The control station is separately located from the plurality of well sites and is in selective electronic communication with the clamp-on flow meters. The control station includes at least one processor adapted to receive the electronic signals from the clamp-on flow meters. The processor is adapted to determine one or more characteristics of the hydrocarbon material flow at each well site using a flow compositional model such as equation of state ("EoS") model.

According to another aspect of the present invention, a method for managing a plurality of hydrocarbon producing well sites is provided. Each of the well sites includes a hydrocarbon material flow passing through a pipe. The method includes the steps of: a) providing a clamp-on flow meter attached to the pipe located at each of the plurality of well sites, wherein each clamp-on flow meter is operable to output electronic signals indicative of at least one characteristic of the hydrocarbon material flowing through the pipe at that well site; b) providing a control station separately located from the plurality of well sites and in selective electronic communication with the clamp-on flow meters, and which control station includes at least one processor adapted to receive the electronic signals from the clamp-on flow meters, and which processor is adapted to determine one or more characteristics of the hydrocarbon material flow at each well site using a flow compositional model such as an equation of state model; c) collectively requesting from the control station the electronic signals from selected ones of the one or more of the clamp-on flow meters; and d) determining one or more characteristics of the hydrocarbon material flow at each well site associated with the selected clamp-on flow meters, using the electronic signals from the selected the clamp-on flow meters.

According to another aspect of the present invention, a system for managing a hydrocarbon producing well site is provided. The well site includes a hydrocarbon material flow passing through a pipe. The system includes a clamp-on flow meter attached to the pipe located at the well site, and a control station. The clamp-on flow meter is operable to output electronic signals indicative of at least one characteristic of the hydrocarbon material flowing through the pipe. The control station is separately located from the well site and is in selective electronic communication with the clamp-on flow meter. The control station includes at least one processor adapted to receive the electronic signals from the clamp-on flow meter. The processor is adapted to determine one or more characteristics of the hydrocarbon material flow using a flow compositional model such as an equation of state model.

The present system and method and advantages associated therewith will become more readily apparent in view of the detailed description provided below, including the accompanying drawings.

DESCRIPTION OF THE INVENTION

Figure 1:
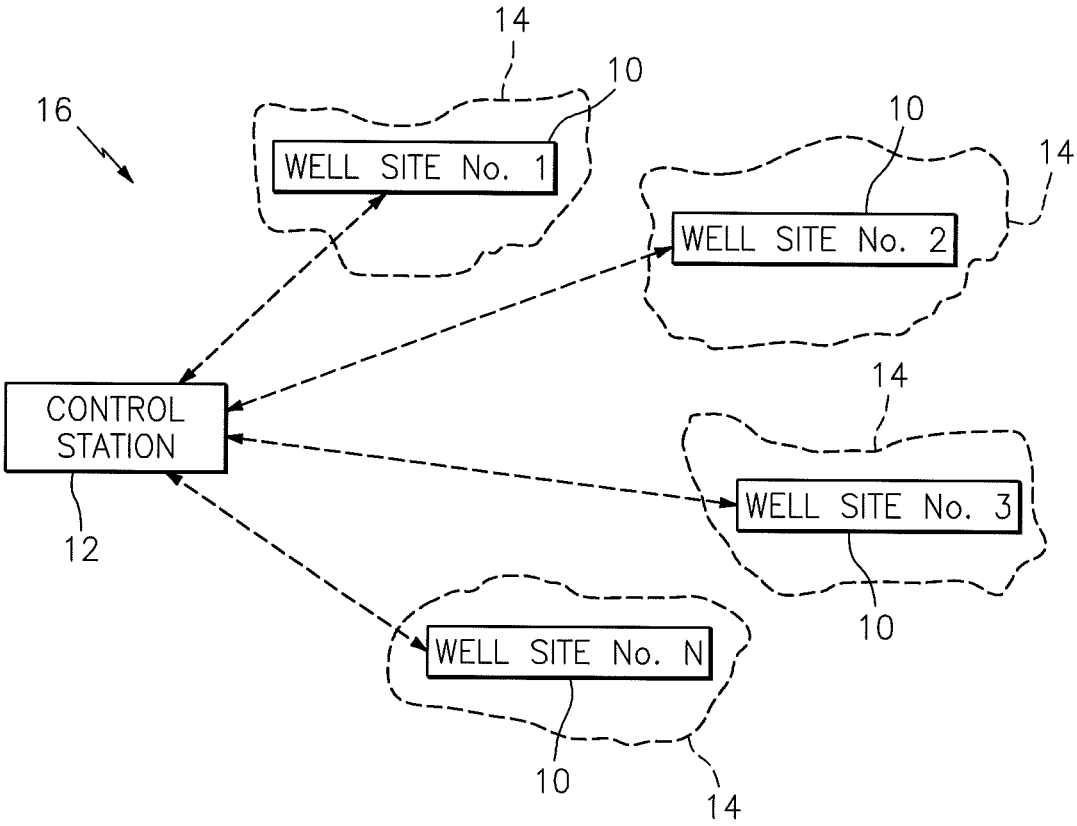
FIG. 1 is a diagrammatic illustration of the present system and method, illustrating a control station separately located from and in communication with a plurality of well sites, with each well site located in a different geographic location and accessing a different subterranean hydrocarbon reservoir.
Figure 2:
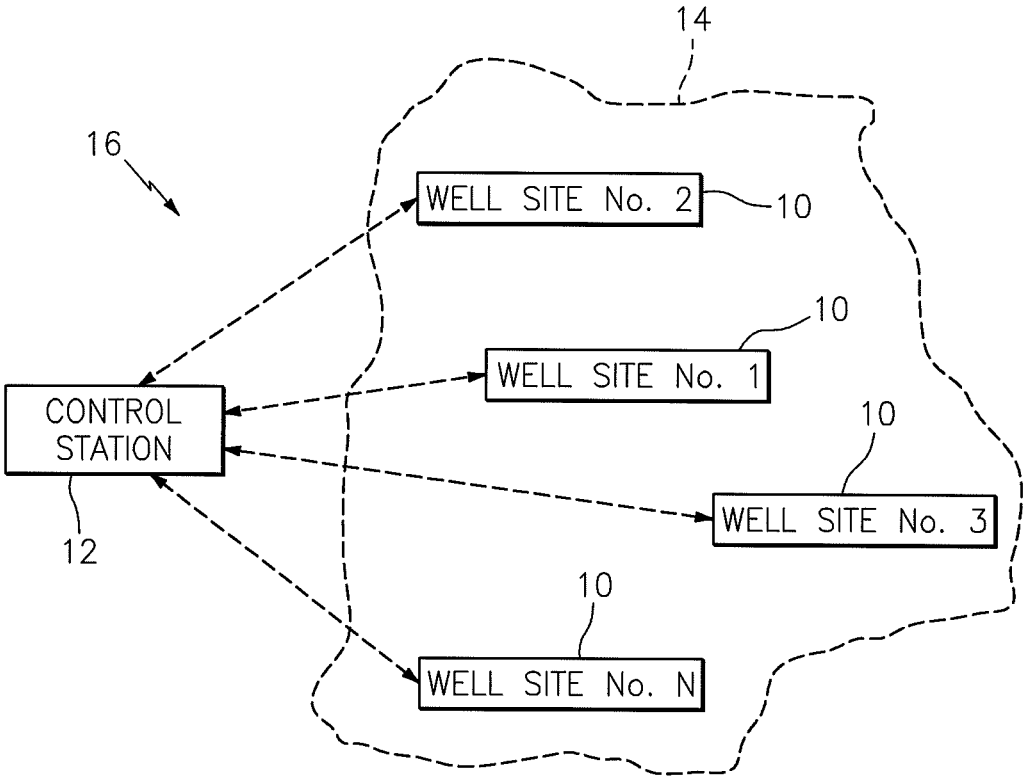
FIG. 2 is a diagrammatic illustration of the present system and method, illustrating a control station separately located from and in communication with a plurality of well sites, with each well site located in a different geographic location and accessing the same subterranean hydrocarbon reservoir.
Figure 3:
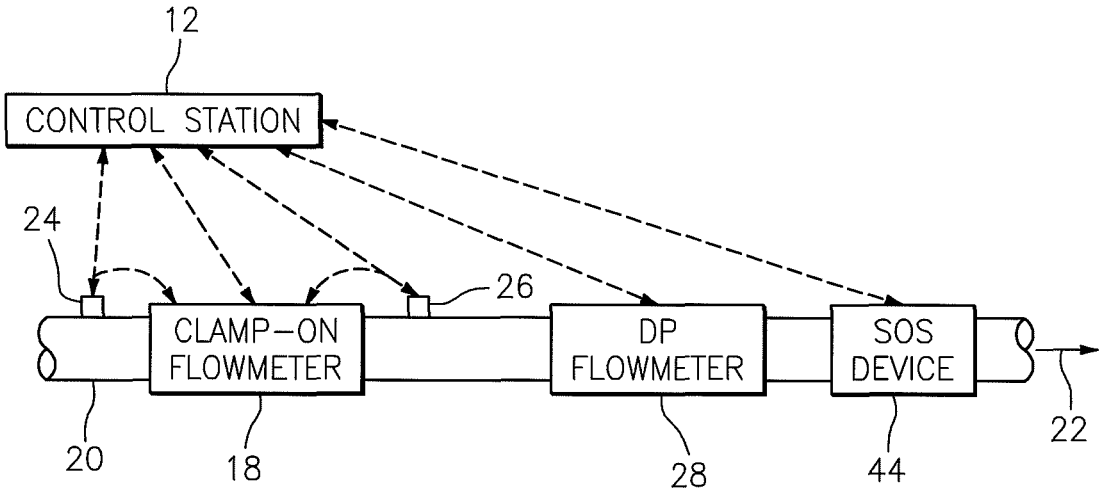
FIG. 3 is a diagrammatic illustration of a clamp-on flow meter and other hardware disposed to sense characteristics of a hydrocarbon flow within a pipe at a well site.

Referring to FIGS. 1-3, aspects of the present invention include a method and system for management of one or more well sites 10 using at least one control station 12, which control station 12 is separately located from the one or more well sites 10. Well sites 10 are typically located proximate at least one underground reservoir (referred to hereinafter as a "field 14") containing hydrocarbon materials (e.g., oil, gas) disposed therein. The system 16 includes at least one clamp-on flow meter 18 disposed on a fluid flow conduit (hereinafter referred to as a "pipe 20") disposed at each well site, and the control station 12. The hydrocarbon materials traveling through a pipe 20 (hereinafter referred to as a "hydrocarbon flow 22") may include materials in a variety of forms (liquid, gas, particulate matter, etc.), and may be characterized generally as black oil, gas condensates, and dry gas, but are not limited to these constituents; e.g., the hydrocarbon flow 22 may include water. The system 16 also includes a mechanism (e.g., a probe 24) for determining the temperature of the hydrocarbon flow 22, and a mechanism (e.g., a transducer 26) for determining the pressure (dynamic, or static or both) of the hydrocarbon flow 22. In both instances, the mechanisms for determining the temperature and the mechanism for determining the pressure may be devices dedicated to providing this information to the system 16, or alternatively the flow temperature and pressure values may be provided to the system 16 from other devices associated with the well site, not dedicated to the system 16. To facilitate the system 16 description hereinafter, the term "temperature probe" is used herein to refer to a source of a temperature value for the hydrocarbon flow 22 in the pipe 20 proximate the location of the system 16, and the term "pressure transducer" is used herein to refer to a source of a pressure value for the hydrocarbon flow 22 in the pipe 20 proximate the location of the system 16.

In some embodiments, the system 16 may also include a differential pressure-based flow meter 28, commonly referred to as a "Dflow meter", operable to measure characteristics of the flow 22 traveling within the pipe 20, proximate the location where the clamp-on flow meter 18 is attached to the pipe 20. DP flow meters 28 can be used to monitor gas production and are well-known to over-report the gas flow rate of a multiphase fluid flow 22 in the presence of liquids within the multiphase flow. The tendency of a DP flow meter 28 to over report due to wetness indicates a strong correlation with the liquid to gas mass ratio of the flow 22. As used herein, the term "Dflow meter" refers to a device that is operable to determine a pressure drop of a flow of fluid, or gas, or mixture thereof, traveling within a pipe 20 across a constriction within that pipe 20, or through a flow length of pipe 20. Examples of DP flow meters 28 that utilize a constriction include, but are not limited to, venturi, orifice, elbow, V-cone, and wedge type flow meters.

The clamp-on flow meters 18 used in the system 16 are typically configured to be mounted on circular pipes, but the clamp-on flow meters 18 used herein are not limited to use with circular piping. The term "separately located" is used to mean that the control station 12 is physically separate from a clamp-on flow meter 18 at a well site 10, but is in selective electronic communication with the clamp-on flow meter 18, as will be detailed below. As an example of "separate location", the control station 12 may be located at a service provider's facility, which facility is geographically remote from a well site 10; e.g., kilometers away, including possibly on a different continent. FIG. 1 is a diagrammatic illustration of a control station 12 separately located from well sites 1, 2, 3 . . . N, each of which well sites 10 is located in a different field 14. As another example, one or more well sites 10 may be disposed in a substantially large field 14. In this instance, the control station 12 may also be located proximate the field 14 and in selective electronic communication with one or more well site clamp-on flow meters 18, but the control station 12 is physically separated from each of the clamp-on flow meters 18. FIG. 2 is a diagrammatic illustration of a control station 12 separately located from well sites 1, 2, 3 . . . N, each of which well sites 10 is located in the same field 14.

A variety of different types of clamp-on flow meters 18 operable to measure hydrocarbon flow 22 characteristics can be used with the present system 16 and within the present method. Examples of acceptable clamp-on flow meters are disclosed in U.S. Pat. Nos. 8,452,551; 8,061,186; 7,603,916; 7,437,946; 7,389,187; 7,322,245; 7,295,933; 7,237,440; and 6,889,562 each of which are hereby incorporated by reference in its entirety. To facilitate the description of the present system and method, a brief description of exemplary clamp-on flow meter 18 types that can be used with the present system 16 is provided.

Figure 4:
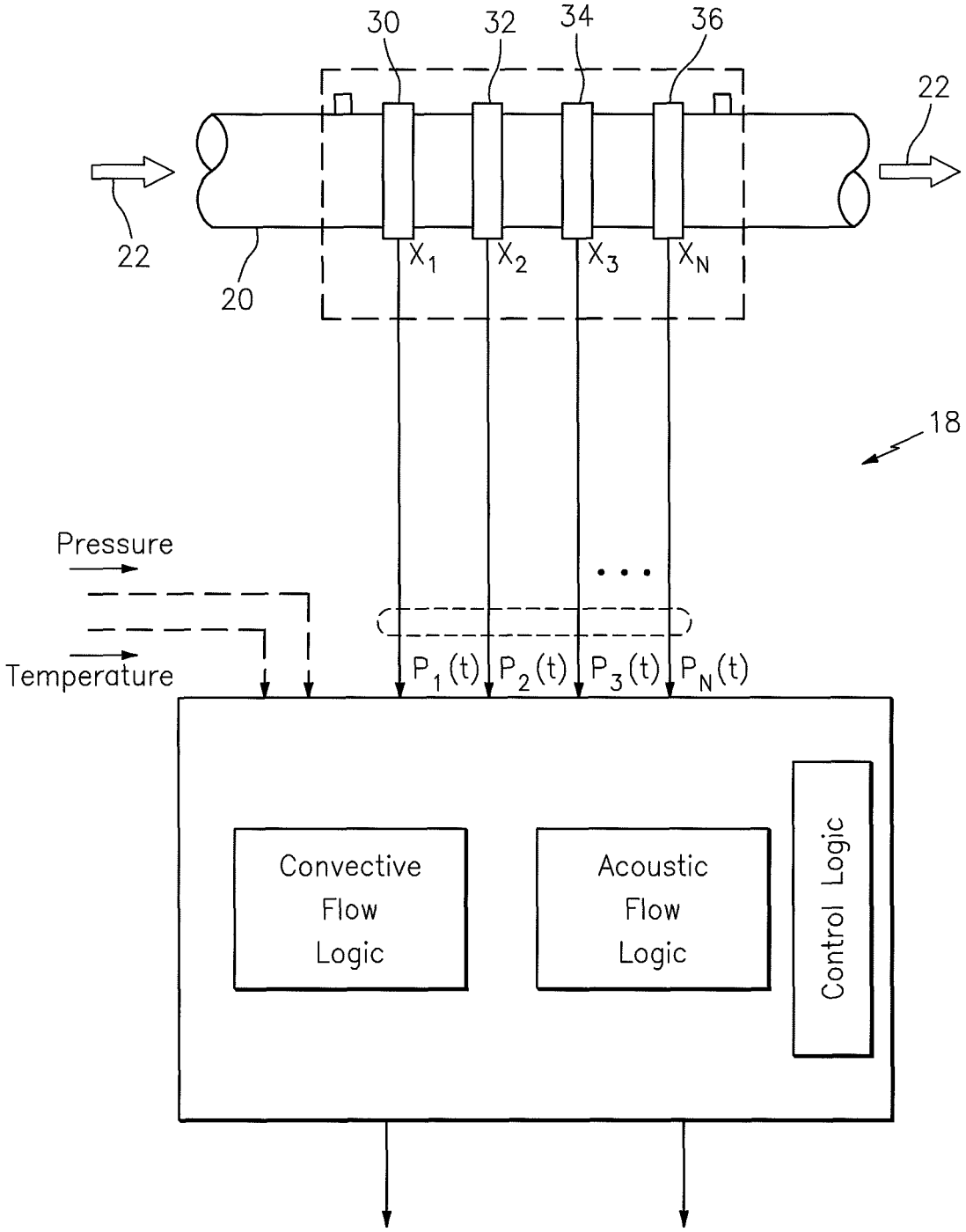
FIG. 4 is a diagrammatic illustration of a passive SONAR type clamp-on flow meter.

In some embodiments, the clamp-on flow meter 18 may be a passive SONAR type flow meter that monitors unsteady pressures convecting with the flow 22 to determine the flow velocity. Referring to FIG. 4, a passive type flow meter 18 may include a sensing device having an array of strain-based sensors or pressure sensors 32-36 for measuring unsteady pressures that convect with the flow 22 (e.g., vortical disturbances within the pipe 20 and/or speed of sound propagating through the flow), which are indicative of parameters and/or characteristics of the hydrocarbon flow 22. The array of strain-based or pressure sensors 32-36 are mounted to the pipe at locations $x_1$, $x_2$, . . . $x_N$ disposed axially along the pipe 20 for sensing respective stochastic signals propagating between the sensors 32-36 within the pipe 20 at their respective locations. Each sensor 32-36 provides a signal (e.g., an analog pressure time-varying signal $P_1(t)$, $P_2(t)$, $P_3(t)$, . . . $P_N(t)$) indicating an unsteady pressure at the location of that sensor, at each instant in a series of sampling instants. The time-varying signals $P_1(t)$-$P_N(t)$ are provided to a signal processing unit 38, which unit serially processes the pressure signals to determine flow parameters, including the velocity and/or volumetric flow rate of the hydrocarbon flow 22 within the pipe 20. The clamp-on flow meter 18 is operable to produce electronic signals indicative of data (e.g., the flow velocity and/or the volumetric flow rate) in a form (e.g., data files, etc.) that can be sent electronically communicated over a wired or wireless infrastructure; e.g., telecommunications via the internet by wired or wireless path through cellular or satellite technology. The clamp-on flow meter 18 may also be adapted to receive electronic signals from the control station 12.

Figure 5:
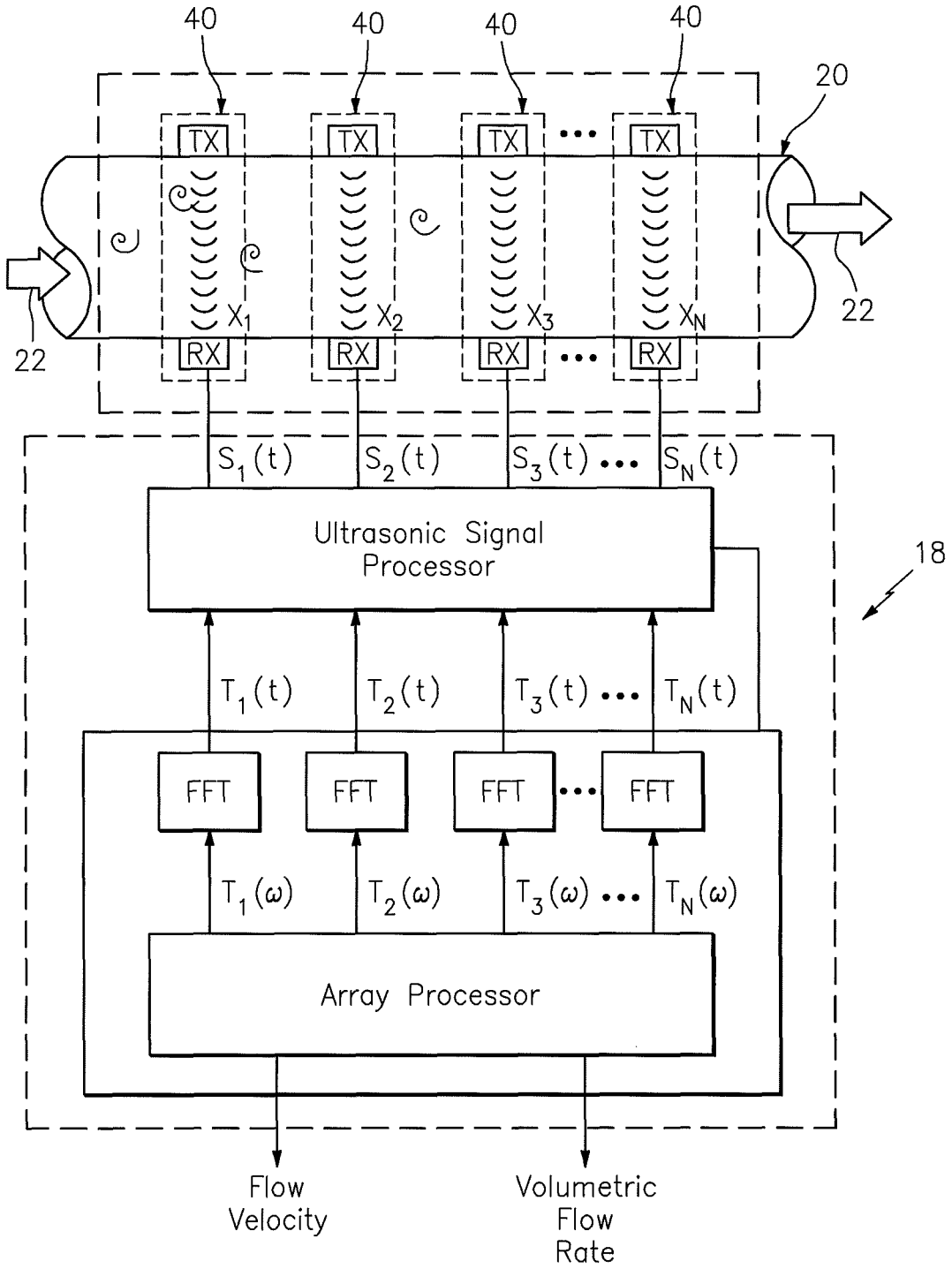
FIG. 5 is a diagrammatic illustration of an active SONAR type clamp-on flow meter.

Now referring to FIG. 5, in other embodiments the clamp-on flow meter 18 may be an active SONAR-type flow meter 10 that includes a spatial array of at least two sensors 40 disposed at different axial positions ($x_1$, $x_2$, . . . $x_n$) along a pipe 20. Each of the sensors 40 provides a signal indicative of a characteristic of the flow 22 passing through the pipe 20. The signals from the sensors 40 are sent to processors (e.g., an ultrasonic signal processor and an array processor) where they are processed to determine the velocity of the flow 22 passing within the pipe 20 by the sensor array. The volumetric flow rate can then be determined by multiplying the velocity of the flow 22 by the cross-sectional area of the pipe 20.

Each ultrasonic sensor 40 includes a transmitter (Tx) and a receiver (Rx) typically, but not necessarily, positioned in the same plane across from one another on opposite sides of the pipe 20. Each sensor 40 measures the transit time of an ultrasonic signal (sometimes referred to as "time of flight" or "TOF"), passing from the transmitter to the receiver. The TOF measurement is influenced by coherent properties that convect within the flow 22 within the pipe 20 (e.g., vortical disturbances, bubbles, particles, etc.). These convective properties, which convect with the flow 22, are in turn indicative of the velocity of the flow 22 within the pipe 20. The effect of the vortical disturbances (and/or other inhomogenities within the fluid) on the TOF of the ultrasonic signal is to delay or speed up the transit time, and particular vortical disturbances can be tracked between sensors 40.

The processors are used to coordinate the transmission of signals from the transmitters and the receipt of signals from the receivers ($S_1(t)$-$S_N(t)$). The processors process the data from each of the sensors 12 to provide an analog or digital output signal ($T_1(t)$-$T_N(t)$) indicative of the TOF of the ultrasonic signal through the fluid. Specifically, the output signals ($T_1(t)$-$T_N(t)$) from an ultrasonic signal processor are provided to an array processor, which processes the transit time data to determine flow parameters such as flow velocity and volumetric flow rate. The clamp-on flow meter 18 is operable to produce electronic signals indicative of data (e.g., the flow velocity and/or the volumetric flow rate) in a form (e.g., data files, etc.) that can be electronically communicated over a wired or wireless infrastructure; e.g., telecommunications via the internet by wired or wireless path through cellular or satellite technology. The clamp-on flow meter 18 may also be adapted to receive electronic signals from the control station 12.

Now referring to FIGS. 3 and 6-8, the control station 12 is in electronic communication (directly or indirectly) with the clamp-on flow meter(s) 18, the temperature probe 24, and the pressure transducer 26 deployed at the well site(s) 10. In those embodiments where the system 16 includes a DP meter 28, the control station 12 is also in electronic communication (directly or indirectly) with the DP meter 28. In some embodiments, one or more of the temperature probe 24, pressure transducer 26, and DP meter 28 may also electronically communicate with the clamp-on flow meter 18, and/or may communicate with the control station 12 through the clamp-on flow meter 18, which communication path is an example of an indirect communication between the respective element and the control station 12.

The term "electronic communication" is used herein to describe the transmission of electronic signals (e.g., data, data files, instructions, etc.) between a clamp-on flow meter 18, a temperature probe 24, a pressure transducer 26, a DP meter 28, and/or a SOS device 44, and the control station 12, which communications can be sent electronically over a wired or wireless infrastructure; e.g., telecommunications via the Internet by wired or wireless path through cellular or satellite technology.

The control station 12 may include one or more processors 46, memory/storage devices, input/output devices (e.g., keyboard, touch screen, mouse, etc.), and display devices. These components may be interconnected using conventional means; e.g., hardwire, wireless communication, etc. The processor(s) 46 is capable of: a) receiving the signal communications from the clamp-on flow meters 18 (and other devices such as the temperature probe 24, pressure transducer 26, DP meter 28, as applicable); b) processing the signal communications according to user input commands and/or according to executable instructions stored or accessible by the processor 46; and c) displaying information on a display device. The processor 46 may be a microprocessor, a personal computer, or other general purpose computer, or any type of analog or digital signal processing device adapted to execute programmed instructions. Further, it should be appreciated that some or all of the functions associated with the flow logic of the present invention may be implemented in software (using a microprocessor or computer) and/or firmware, or may be implemented using analog and/or digital hardware, having sufficient memory, interfaces, and capacity to perform the functions described herein.

In some embodiments, the control station processor(s) 46 are adapted to use a flow compositional model (which may be in the form of an algorithm) such as an equation of state ("EoS") model and the pressure, volume, and temperature properties (i.e., the data values determined at the well site and sent via the signal communications) to analyze and determine characteristics of the hydrocarbon flow 22 being evaluated. The flow compositional model typically includes empirical data collected from the particular well site or field based on hydrocarbon flow material previously removed from the well site or field.

Figure 6:
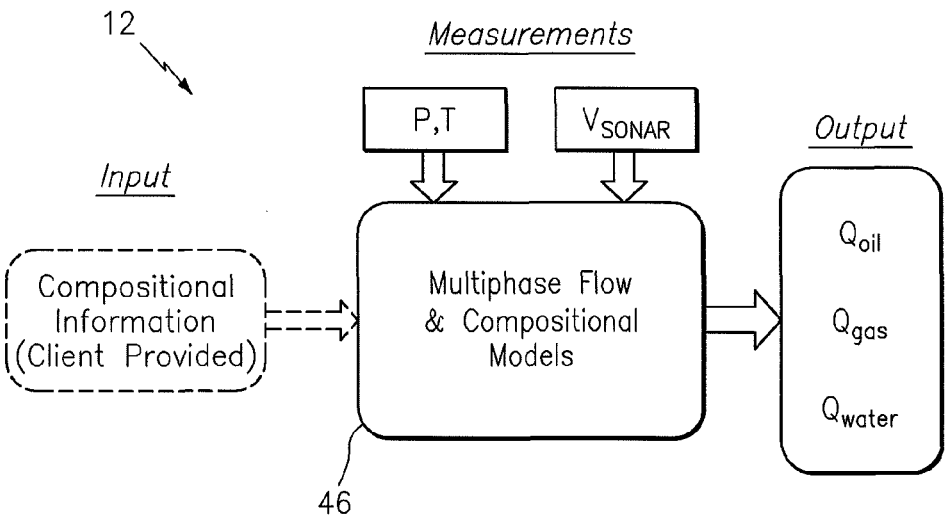
FIG. 6 is a diagrammatic representation of the functionality provided by an embodiment of a present invention control station.

For example, FIG. 6 diagrammatically illustrates a flow chart of the input, operation, and output of an embodiment of the control station processor 46. FIG. 6 illustrates the input values (e.g., flow velocity ("$V_{SONAR}$"), flow pressure data ("P"), and flow temperature data ("T")) which would be electronically communicated from the well site 10 by the clamp-on flow meter 18, pressure transducer 26, and temperature probe 24 respectively, as inputs into the control station processor 46. In this example, the processor 46 is programmed or otherwise adapted with an EoS model, which model is typically referred to as a "PVT Model". PVT models are commercially available; e.g., the "PVTsim" model produced by Calsep A/S of Lyngby, Denmark. As can be seen from FIG. 6, composition data representative of the hydrocarbon flow 22 at the well site (e.g., C1, C2, C3 . . . Cn, where each "C" value represents a particular hydrocarbon constituent within the flow) is also entered into the processor 46. Using the pressure and temperature values, the pipe dimensional information, the flow velocity determined from the flow meter 10, and the PVT Model, the processor 46 may be adapted to determine the flow velocities and/or the volumetric flow rates of one or both the gas and liquid phases of the hydrocarbon 22 at one or both of an actual temperature and pressure, or a standard temperature and pressure (e.g., ambient temperature and pressure). As indicated above, the flow meter 18 that provides the flow velocities and/or the volumetric flow rates can be, for example, a passive type SONAR flow meter or an active type SONAR flow meter.

Figure 7:
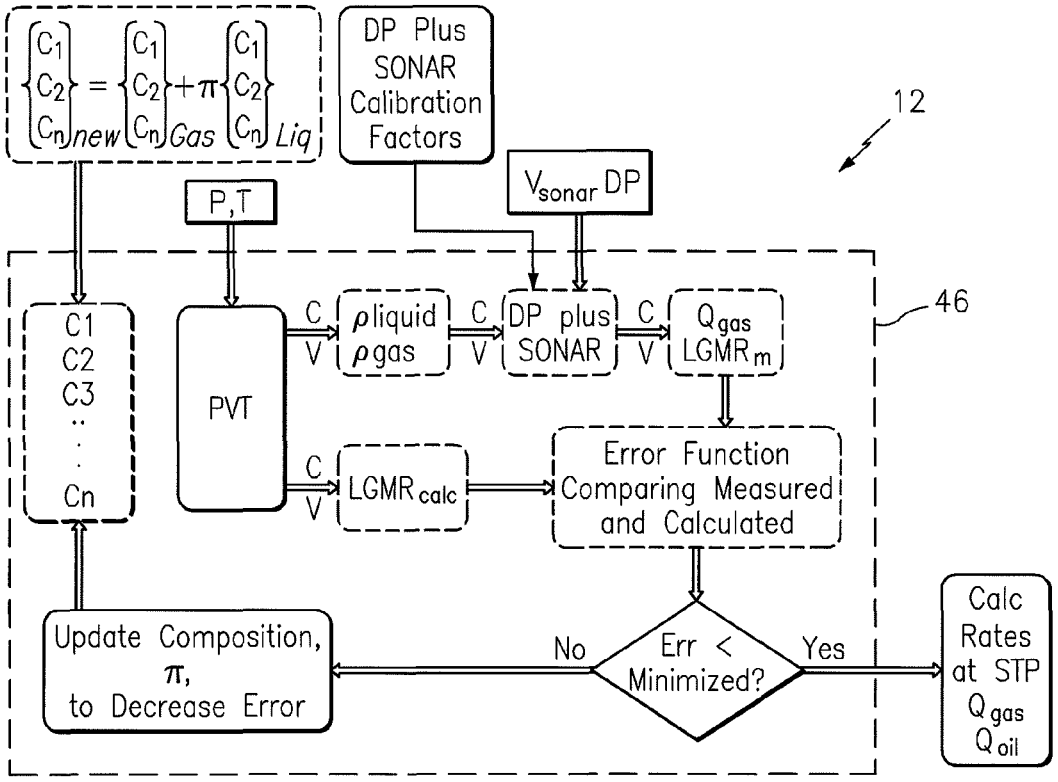
FIG. 7 is a diagrammatic representation of the functionality provided by another embodiment of a present invention control station.

The diagrammatic flow chart shown in FIG. 7 illustrates the input, operation, and output of an alternative embodiment of the control station 12. FIG. 7 illustrates the input values (e.g., flow velocity ("$V_{SONAR}$"), flow pressure data ("P"), flow temperature data ("T"), and differential pressure flow velocity ("DP")) which would be electronically communicated from the well site 10, as inputs into the control station processor 46. The processor 46 is programmed or otherwise adapted with a PVT Model. This embodiment leverages the fact that SONAR type clamp-on flow meters and DP flow meters report gas flow rates differently in the presence of liquids within a multiphase flow 22. Specifically, a SONAR flow meter 18 will continue to accurately report gas flow rates, independent of the liquid loading, but a DP meter 28 will over report gas flow rates when a liquid is present within a multiphase flow 22 (i.e., a "wet gas flow"). The insensitivity of the SONAR flow meter 18 to "wetness" within the flow 22 provides a practical means for accurately measuring the gas flow rate and the liquid flow rate of a wet gas flow 22. In the processing of the combined data (i.e. data obtained from the DP meter and the SONAR flow meter), a set of local wetness sensitivity coefficients for each wetness series (at fixed pressure and flow rate) can be used to provide a more accurate characterization for both the DP meter and the SONAR flow meter to determine wetness. The wetness sensitivity coefficients for each device may be provided by a low order polynomial fit of the over-report vs. wetness. This characterization may then be used to "invert" the outputs of the DP meter and the SONAR flow meter to provide an accurate gas flow rate (e.g., "$Q_{gas}$") and an accurate liquid flow rate (e.g., "$Q_{oil}$").

Figure 8:
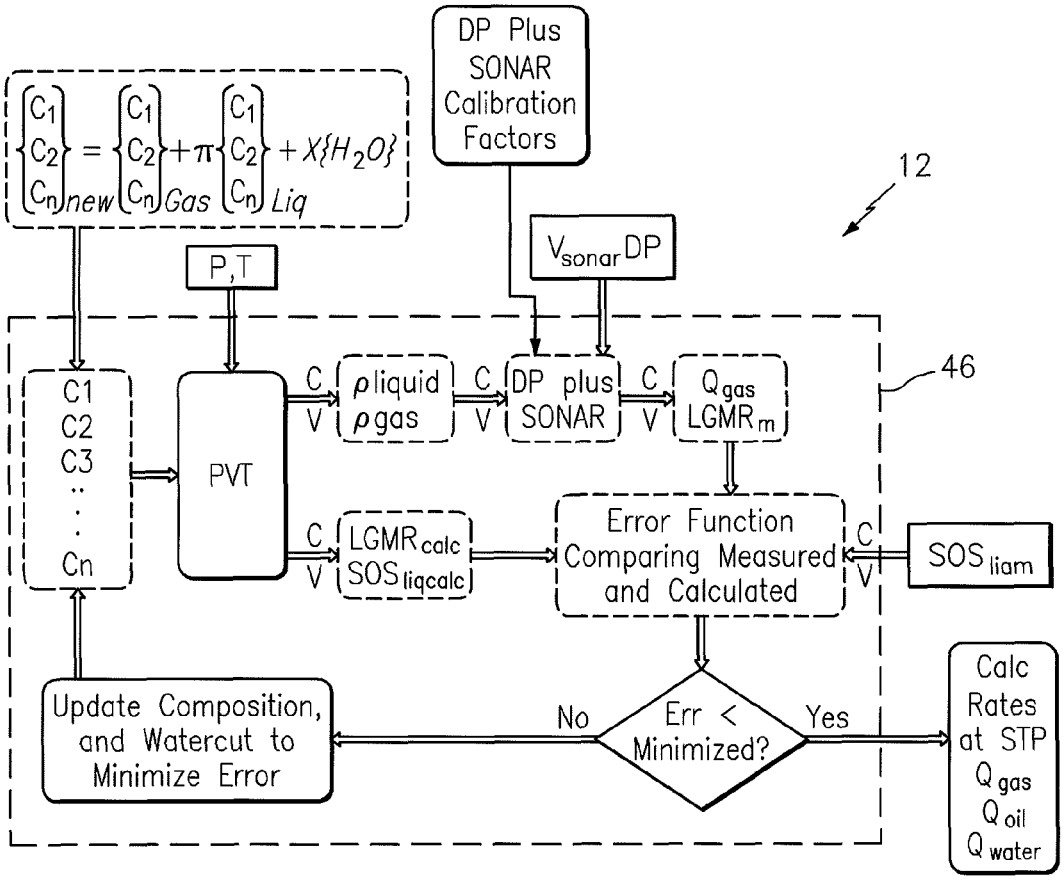
FIG. 8 is a diagrammatic representation of the functionality provided by another embodiment of a present invention control station.

The diagrammatic flow chart shown in FIG. 8 illustrates the input, operation, and output of another alternative embodiment of the control station processor 46. FIG. 8 illustrates the input values (e.g., flow velocity ("$V_{SONAR}$"), flow pressure data ("P"), flow temperature data ("T"), and the differential pressure flow velocity ("DP"), and the speed of sound ("SOS") for the liquid phase within the hydrocarbon flow 22) which would be electronically communicated from the well site 10, as inputs into the control station processor(s) 46. This embodiment may be used to analyze a three phase hydrocarbon flow 22; e.g., a flow containing gas, hydrocarbon liquid (e.g., oil), and water. As can be seen from FIG. 8, composition data representative of the hydrocarbon flow 22 at the well site (e.g., C1, C2, C3 . . . Cn) is also entered into the processor 46. The processor 46 is adapted to use these inputs to determine an accurate gas flow rate (e.g., "$Q_{gas}$"), an accurate hydrocarbon flow rate (e.g., "$Q_{oil}$"), and an accurate water flow rate (e.g., "$Q_{water}$").

The control station processor(s) 46 may be further adapted to use the well site determined characteristics (e.g., the flow velocities) to determine performance data for the well site 10, or for a plurality of well sites 10. For example, the control station 12 may be adapted to create (e.g., using the processor(s)) the performance data for a particular well site 10, or well sites 10, to create a current performance "snap shot". A snap shot of the performances of some or all of the well sites 10 in a particular field 14 at a given time can be useful to evaluate current status. There is believed to be considerable value in knowing the well site performance data for some number, or all of the well sites 10 for a given field 14 at a given point in time. The phrase "at a given point in time" is used herein to refer to operating the present system 16 to get information from a plurality of different well sites 10 within a relatively small amount of time that for operating purposes can be considered at a single point in time.

Alternatively, the control station processor(s) 46 may be adapted to create and store performance data (e.g., in the memory/storage device) at predetermined intervals (e.g., at regular intervals) over a predetermined period of time; e.g., days, weeks, months, years, etc. The control station processor 46 may be further adapted to analyze the periodically developed performance data for a particular well site 10, or well sites 10, to create a historical performance perspective for that particular well site 10, or those particular well sites 10.

The methodologies with which the above described system can be implemented is clearly apparent from the description above. To summarize for the sake of clarity, the present method for managing a plurality of hydrocarbon producing well sites, wherein each of the well sites includes a hydrocarbon material flow passing through a pipe, can be generally described in the following steps. A clamp-on flow meter is provided and attached to a pipe located at each of the plurality of well sites. The hydrocarbon material flow 22 drawn from the subterranean reservoir passes through the pipe. At this point the flow 22 may or may not have been subjected to a separation process. Each clamp-on flow meter is operable to output electronic signals indicative of at least one characteristic of the hydrocarbon material flowing through the pipe at its respective well site 10. A control station is provided separately located from the plurality of well sites and in selective electronic communication with the clamp-on flow meters. The term "selective" is used to indicate that the communication can be specifically chosen; e.g., on demand, periodic, or continuous. The control station 12 includes at least one processor 46 adapted to receive the electronic signals from the clamp-on flow meters 18. The processor(s) 46 is adapted to determine one or more characteristics of the hydrocarbon material flow 22 at each well site 10 using a compositional model or algorithm; e.g., an EoS model. The control station (via the processor 46) may collectively request (or receive) inputs; e.g., the electronic signals from selected ones of the one or more of the clamp-on flow meters. The control station processor 46 determines one or more characteristics of the hydrocarbon material flow at each well site 10 associated with the selected clamp-on flow meters 18, using the electronic signals from the selected the clamp-on flow meters 18.

According to another aspect of the present invention, a method for managing a plurality of hydrocarbon producing well sites can be implemented by a field trained technician collecting well site data for one or more well sites and subsequently communicating that data to the control station for analysis at the control station by a data analysis technician. For example, a field technician can be deployed to a particular field that includes a plurality of well sites. The technician can: a) apply a clamp-on flow meter on each of a desired number of well sites (e.g., all of the well sites, or on predetermined ones of the well sites); b) operate the clamp-on flow meter and collect flow velocity and/or flow volumetric data, flow pressure and temperature data (e.g., $V_{SONAR}$, P, T) from each particular well site; and c) electronically communicate the acquired flow data of each particular well site to the control station for subsequent processing. The electronic communication may occur after each well site is tested, or collectively after a plurality of well sites have been tested. In some instances, the technician may store the acquired data in a device capable of storing the data (e.g., a laptop, a CD, a memory stick, a portable hard drive, etc.), which data storage device can then be delivered to the control station. Upon receiving the data storage device, a technician at the control station may then further process the acquired well site data. In some instances, a combination of electronic communication and data storage device delivery can be used. Although this method is described above in terms of a field technician applying a clamp-on flow meter to each well site (e.g., collect data using a clamp-on flow meter at a first well site, subsequently move to a second well site and operate the clamp-on flow meter, subsequently move to a third well site and operate the clamp-on flow meter, etc.), this method embodiment also contemplates that more than one field technician can be used to collect data (e.g., within a particular field), or that a single technician may install and operate more than one clamp-on flow meter, etc.

A significant advantage of the present system and method is that it substantially increases the amount of well site information that can be collected, and the speed at which it can be collected for one or more well sites 10 regardless of where the well sites 10 are located. For example in instances where a plurality of well sites 10 have clamp-on flow meters 18 installed in geographically different locations, the present system and method permits the performance of those well sites 10 to be monitored from the control station 12 at a given point in time; i.e., real time data. In addition, the present system and method allows the well site performance data to be collected over an extended period of time. Historical performance data can be used to create valuable predictive models relating to field strength and field depletion, to schedule operational changes, to determine hydrocarbon flow constituent changes, and the like. This type of information can permit issue identification and development of corrective actions (e.g., workover operations, implementation of secondary or tertiary recovery mechanisms, etc.) in real time and at substantially reduced costs. The corrective actions can help achieve attainment of desired production levels and maximization of overall production and revenue at speeds believed to be not possible with prior art systems and techniques.

Another significant advantage of the present system and method is that it facilitates well site management. For example, the present system 16 allows for optimum use of personnel. In prior art systems, it was often necessary to have significant personnel resources stationed proximate the well site 10. For example, using prior art systems it was often necessary to have either: a) data analytical knowledge level personnel (e.g., petroleum engineers, computer processing engineers, etc.) and well site operation knowledge level personnel (e.g., well site technicians and operators) stationed at the well site 10; or b) have a single technician that is trained to perform both well site data acquisition tasks and data analysis tasks. A problem with the first option is the labor cost and requisite coordination of multiple people at a well site. A problem with the second option is that technicians trained to perform data acquisition tasks at the well site 10 and to perforin data analysis tasks are expensive and difficult to find. The present system and method resolves these problems. For example, in those embodiments wherein a plurality of clamp-on flow meters 18 are installed and acquiring data, one data analysis technician can monitor a plurality of well sites 10 from a single location. The operator of the well site 10 can then use the performance data to make decisions regarding the operation of the well site 10. As another example, in those embodiments where one or more field technicians sequentially collect data from a plurality of well sites, that field technician can efficiently collect the well site flow data and subsequently communicate it to the control station for analysis by a data analysis technician for evaluation.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A system for managing a plurality of hydrocarbon producing well sites, wherein each of the well sites includes a hydrocarbon material flow passing through a pipe, the system comprising:

a clamp-on flow meter attached to the pipe located at each of the plurality of well sites, wherein each clamp-on flow meter is operable to output electronic signals indicative of at least one characteristic of the hydrocarbon material flowing through the pipe at that well site;

a control station separately located from the plurality of well sites and in selective electronic communication with the clamp-on flow meters, and which control station includes at least one processor adapted to receive the electronic signals from the clamp-on flow meters, and which processor is adapted to determine one or more characteristics of the hydrocarbon material flow at each well site using a flow compositional model; and at least one temperature sensing device adapted to produce a temperature value signal indicative of a temperature of the hydrocarbon material flow in the pipe proximate the clamp-on flow meter at each well site, and at least one pressure sensing device adapted to produce a pressure value signal indicative of a pressure of the hydrocarbon material flow in the pipe proximate the clamp-on flow meter at each well site;

wherein the control station processor is adapted to periodically collectively request the electronic signals from selected ones of the one or more of the clamp-on flow meters over a period of time, and to receive the electronic signals from the selected the clamp-on flow meters; and wherein the control station processor is in selective electronic communication with the at least one temperature sensing device and with the at least one pressure sensing device, and wherein the control station processor is adapted to receive the temperature value signal and the pressure value signal, and to use the temperature value signal and the pressure value signal to determine the one or more characteristics of the hydrocarbon material flow at the respective well site.

2. The system of claim 1, wherein at least one of the clamp-on flow meters is a passive SONAR type flow meter.

3. The system of claim 1, wherein at least one of the clamp-on flow meters is an active SONAR type flow meter.

4. The system of claim 1, wherein the control station processor is adapted to determine the one or more characteristics of the hydrocarbon material flow at each well site associated with the selected clamp-on flow meters using the periodically requested and received electronic signals.

5. The system of claim 4, wherein the control station processor is adapted to store one or both of: a) the periodically requested and received electronic signals; and b) the determined one or more characteristics of the hydrocarbon material flow at each well site using the periodically requested and received electronic signals, and to analyze one or both of a) the periodically requested and received electronic signals; and b) the determined one or more characteristics of the hydrocarbon material flow at each well site using the periodically requested and received electronic signals, to determine well site performance during the period of time.

6. The system of claim 1, wherein the system further comprises a differential pressure flow meter ("DP flow meter") adapted to produce a DP flow velocity value signal indicative of a differential pressure flow velocity of the hydrocarbon material flow in the pipe proximate the clamp-on flow meter at each well site; and wherein the control station processor is in selective electronic communication with the DP flow meter, and wherein the control station processor is adapted to receive the DP flow velocity value signal, and to use the DP flow velocity value signal to determine the one or more characteristics of the hydrocarbon material flow at the respective well site.

7. A method for managing a plurality of hydrocarbon producing well sites, wherein each of the well sites includes a hydrocarbon material flow passing through a pipe, the method comprising the steps of:

providing a clamp-on flow meter attached to the pipe located at each of the plurality of well sites, wherein each clamp-on flow meter is operable to output electronic signals indicative of at least one characteristic of the hydrocarbon material flowing through the pipe at that well site;

providing a control station separately located from the plurality of well sites and in selective electronic communication with the clamp-on flow meters, and which control station includes at least one processor adapted to receive the electronic signals from the clamp-on flow meters, and which processor is adapted to determine one or more characteristics of the hydrocarbon material flow at each well site using a flow compositional model;

periodically collectively requesting from the control station the electronic signals from selected ones of the one or more of the clamp-on flow meters;

determining one or more characteristics of the hydrocarbon material flow at each well site associated with the selected clamp-on flow meters, using the electronic signals from the selected the clamp-on flow meters;

wherein the determining step uses a temperature value signal indicative of a temperature of the hydrocarbon material flow in the pipe proximate the clamp-on flow meter at each well site, and a pressure value signal indicative of a pressure of the hydrocarbon material flow in the pipe proximate the clamp-on flow meter at each well site to determine the one or more characteristics of the hydrocarbon material flow at the respective well site.

8. The method of claim 7, wherein at least one of the clamp-on flow meters is a passive SONAR type flow meter.

9. The method of claim 7, wherein at least one of the clamp-on flow meters is an active SONAR type flow meter.

10. The method of claim 7, wherein the step of determining one or more characteristics of the hydrocarbon material flow at each well site associated with the selected clamp-on flow meters, is performed using the periodically requested electronic signals from the selected ones of the one or more of the clamp-on flow meters.

11. The method of claim 10, further comprising the steps of:

storing one or both of: a) the periodically requested and received electronic signals; and b) the one or more characteristics of the hydrocarbon material flow at each well site determined by the control station processor using the periodically requested and received electronic signals; and determining well site performance during the period of time using one or both of: a) the periodically requested and received electronic signals; and b) the one or more characteristics of the hydrocarbon material flow at each well site determined using the periodically requested and received electronic signals.

12. The method of claim 7, further comprising the steps of:

providing a differential pressure flow meter ("DP flow meter") adapted to produce a DP flow velocity value signal indicative of a differential pressure flow velocity of the hydrocarbon material flow in the pipe proximate the clamp-on flow meter at each well site; and determining the one or more characteristics of the hydrocarbon material flow at the respective well site using the DP flow velocity value signal.

13. A system for managing a plurality of hydrocarbon producing well sites wherein each of the well sites includes a hydrocarbon material flow passing through a pipe, the system comprising:

a clamp-on flow meter attached to the pipe located at each of the plurality of well sites, wherein each clamp-on flow meter is operable to output electronic signals indicative of at least one characteristic of the hydrocarbon material flowing through the pipe at that well site;

a control station separately located from the plurality of well sites and in selective electronic communication with the clamp-on flow meters, and which control station includes at least one processor adapted to receive the electronic signals from the clamp-on flow meters, and which processor is adapted to determine one or more characteristics of the hydrocarbon material flow at each well site using a flow compositional model;

wherein the control station processor is adapted to periodically collectively request the electronic signals from selected ones of the one or more of the clamp-on flow meters over a period of time, and to receive the electronic signals from the selected the clamp-on flow meters; and wherein the processor is adapted to receive from at least one of the well sites input values that include a flow velocity, flow pressure data, flow temperature data, and a differential pressure flow velocity, and wherein the processor is adapted to determine a wetness of the hydrocarbon material flow passing through the pipe based on a set of local wetness sensitivity coefficients.

14. The system of claim 13, wherein the input values include an input value corresponding to a speed of sound for a liquid phase within the hydrocarbon material flow, and wherein the processor is adapted to determine a gas flow rate, an oil flow rate, and a water flow rate based on the input values.

* * * * *